US007270235B2

(12) United States Patent
Chen

(10) Patent No.: US 7,270,235 B2
(45) Date of Patent: Sep. 18, 2007

(54) REMOVABLE TOOL BOX

(76) Inventor: Chang-Ying Chen, 58, Ma Yuan West St., Taichung (TW)

( * ) Notice: Subject to any disclaimer, the term of this patent is extended or adjusted under 35 U.S.C. 154(b) by 655 days.

(21) Appl. No.: 10/662,927

(22) Filed: Sep. 12, 2003

(65) Prior Publication Data

US 2005/0056560 A1 Mar. 17, 2005

(51) Int. Cl.
*B65D 85/28* (2006.01)

(52) U.S. Cl. ..... 206/379; 206/378; 206/373; 206/349

(58) Field of Classification Search ..... 206/379, 206/349, 251, 250
See application file for complete search history.

(56) References Cited

U.S. PATENT DOCUMENTS 6,105,770 A * 8/2000 Vasudeva ..... 206/378
6,415,923 B1 * 7/2002 Chen ..... 206/379
6,547,074 B1 * 4/2003 Chen ..... 206/379

* cited by examiner

*Primary Examiner*—Mickey Yu
*Assistant Examiner*—Steven Pollicoff

(57) ABSTRACT

A tool box includes a main body, a cover pivotally mounted on the main body, a driving rack movably mounted in the main body, a plurality of receiving portions each pivotally mounted in the main body and each having a side provided with a toothed rotation block meshing with the driving rack, and a rotation gear rotated by the cover and meshing with the driving rack. Thus, when the cover is pivoted relative to the main body to a determined position, each of the receiving portions is pivoted and moved to a vertical position, thereby facilitating the user removing the hand tool, such as the screwdriver tip, from each of the receiving portions.

8 Claims, 8 Drawing Sheets

REMOVABLE TOOL BOX

BACKGROUND OF THE INVENTION

1. Field of the Invention

The present invention relates to a tool box, and more particularly to a removable tool box that facilitates the user removing the hand tool.

2. Description of the Related Art

A conventional tool box comprises a main body having a plurality of receiving portions for receiving and clamping the hand tools, such as the screwdriver tips or the like, and a cover pivotally mounted on the main body. Thus, the user can remove the hand tools from the receiving portions of the main body by pivoting the cover outward relative to the main body. However, the receiving portions are fixed in the main body without movement, thereby causing inconvenience to the user when removing the hand tools from the receiving portions of the main body.

SUMMARY OF THE INVENTION

The primary objective of the present invention is to provide a tool box, wherein when the cover is pivoted relative to the main body to a determined position, each of the receiving portions is pivoted and moved to a vertical position, thereby facilitating the user removing the hand tool, such as the screwdriver tip, from each of the receiving portions.

Another objective of the present invention is to provide a tool box, wherein the locking block of the cover is movable in the guide slot of the rotation gear, thereby forming a time delay during pivotal movement between the cover and the rotation gear, so that when the included angle between the cover and the main body is smaller than a determined degree, the rotation gear is not rotated by pivot of the cover. Thus, only one half of the rotation gear is rotated by pivot of the cover, so that the teeth only need to extend through one half of the outer diameter of the rotation gear, thereby greatly saving costs of fabrication, and thereby simplifying the manufacturing procedures.

A further objective of the present invention is to provide a tool box, wherein the rotation gear is not rotated by pivot of the cover simultaneously, thereby preventing the rotation gear, the driving rack and the rotation block from being worn out due to successive rotation by pivot of the cover, so as to increase the lifetime the rotation gear, the driving rack and the rotation block.

In accordance with the present invention, there is provided a tool box, comprising:

a main body;

a cover pivotally mounted on the main body;

an elongated driving rack movably mounted in the main body;

a plurality of receiving portions each pivotally mounted in the main body and each having a side provided with a toothed rotation block meshing with and rotated by the driving rack; and a rotation gear secured on and rotated by the cover and meshing with the driving rack for moving the driving rack.

Further benefits and advantages of the present invention will become apparent after a careful reading of the detailed description with appropriate reference to the accompanying drawings.

DETAILED DESCRIPTION OF THE INVENTION

Figure 1:
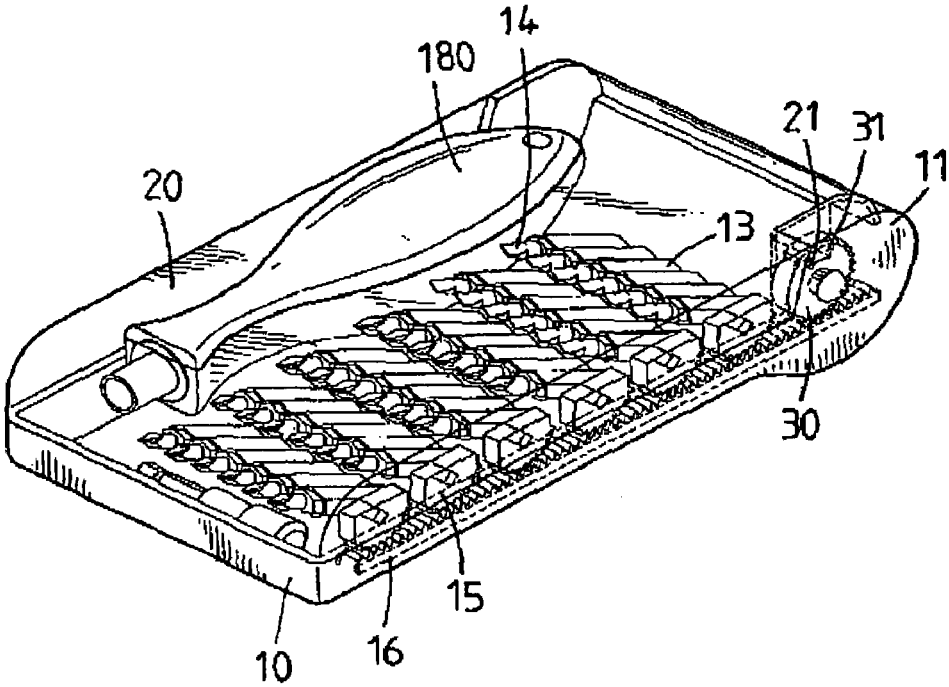
FIG. 1 is a perspective view of a tool box in accordance with the preferred embodiment of the present invention.
Figure 2:
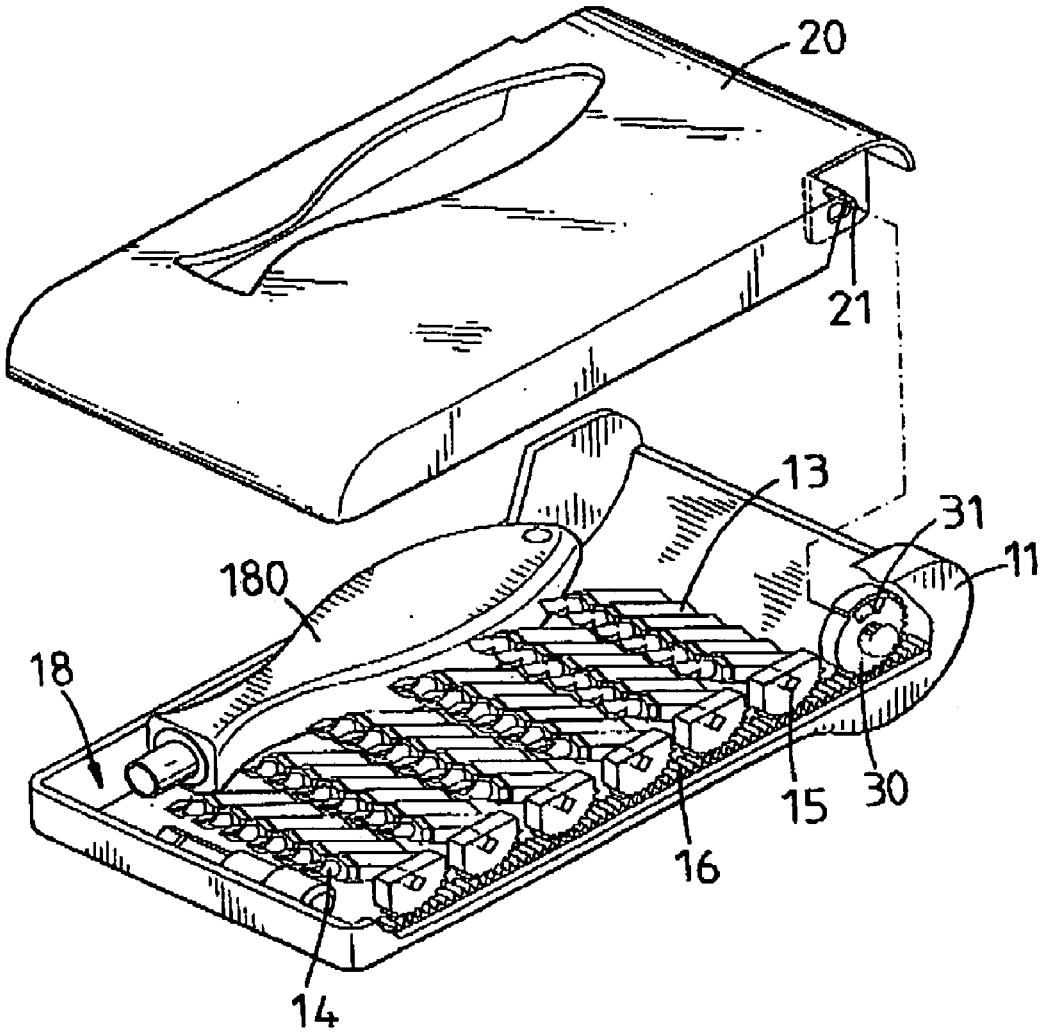
FIG. 2 is a partially exploded perspective view of the tool box as shown in FIG. 1.
Figure 3:
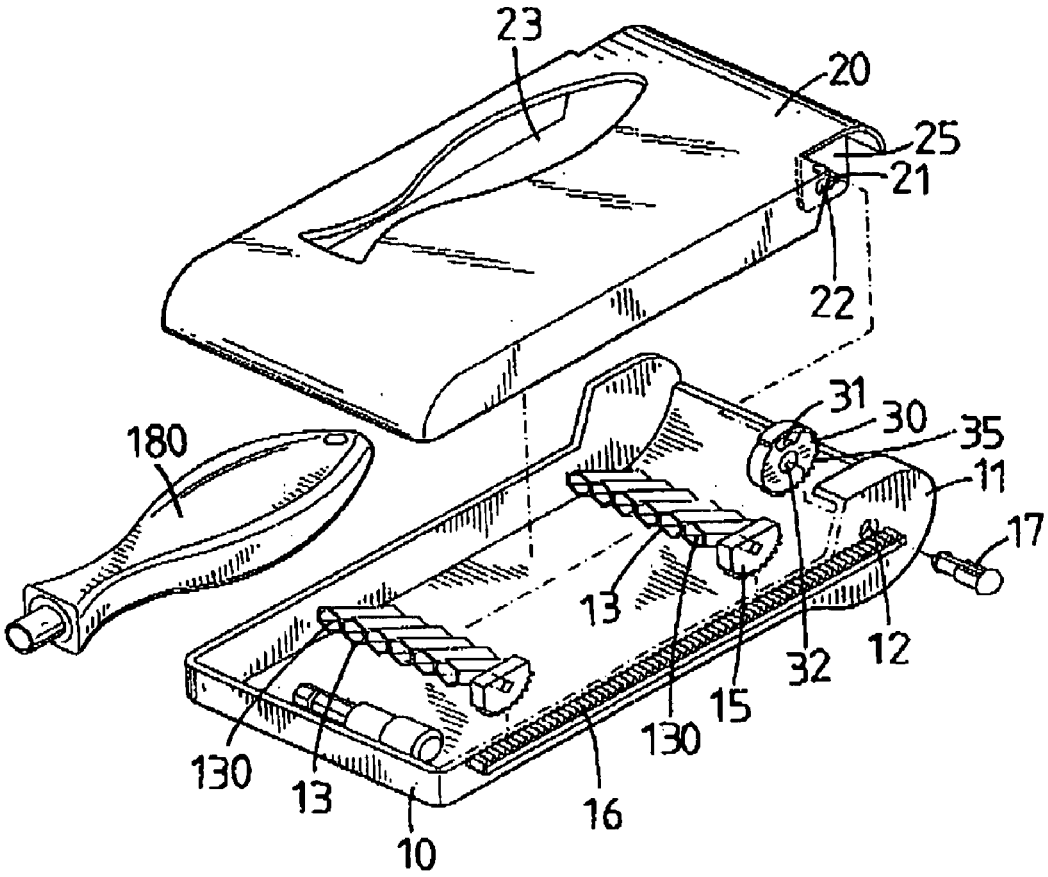
FIG. 3 is an exploded perspective view of the tool box as shown in FIG. 1.

Referring to the drawings and initially to FIGS. 1-5, a tool box in accordance with the preferred embodiment of the present invention comprises a main body 10, a cover 20 pivotally mounted on the main body 10, an elongated driving rack 16 movably mounted in the main body 10, a plurality of receiving portions 13 each pivotally mounted in the main body 10 and each having a side provided with a toothed rotation block 15 meshing with and rotated by the driving rack 16, and a rotation gear 30 secured on and rotated by the cover 20 and meshing with the driving rack 16 for moving the driving rack 16.

The main body 10 has an end provided with a pivot portion 11 formed with a pivot hole 12, the rotation gear 30 has a center formed with a pivot hole 32, the cover 20 has an end provided with a pivot portion 25 formed with a pivot hole 22, and the tool box further comprises a pivot shaft 17 extended through the pivot hole 12 of the main body 10, the pivot hole 32 of the rotation gear 30 and the pivot hole 22 of the cover 20, so that the cover 20 and the rotation gear 30 are rotatably mounted on the main body 10.

Figure 5:
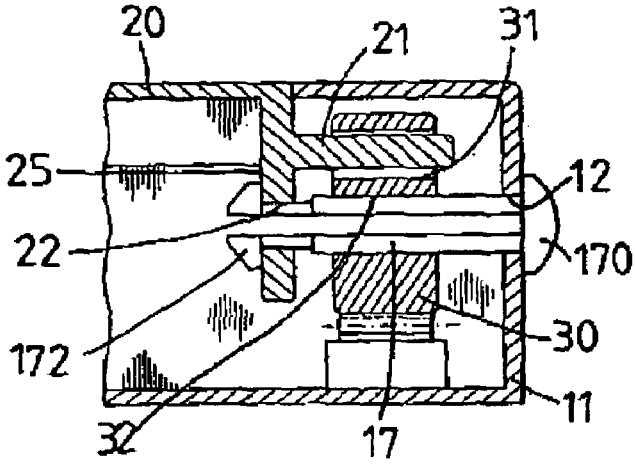
FIG. 5 is a plan cross-sectional view of the tool box taken along line 5-5 as shown in FIG. 4.

In addition, as shown in FIG. 5, the pivot shaft 17 has a first end formed with an enlarged head 170 rested on a wall of the pivot portion 11 of the main body 10 and a bifurcated second end formed with two flexible hooked portions 172 each rested on a wall of the pivot portion 25 of the cover 20.

The main body 10 has a side formed with a receiving space 18 located beside the receiving portions 13 for receiving a tool handle 180. In addition, the cover 20 is formed with a retaining slot 23 for retaining the tool handle 180 to prevent the tool handle 180 from detaching from the cover 20. In addition, each of the receiving portions 13 is formed with a receiving recess 130 for receiving a respective screwdriver tip 14.

Figure 4:
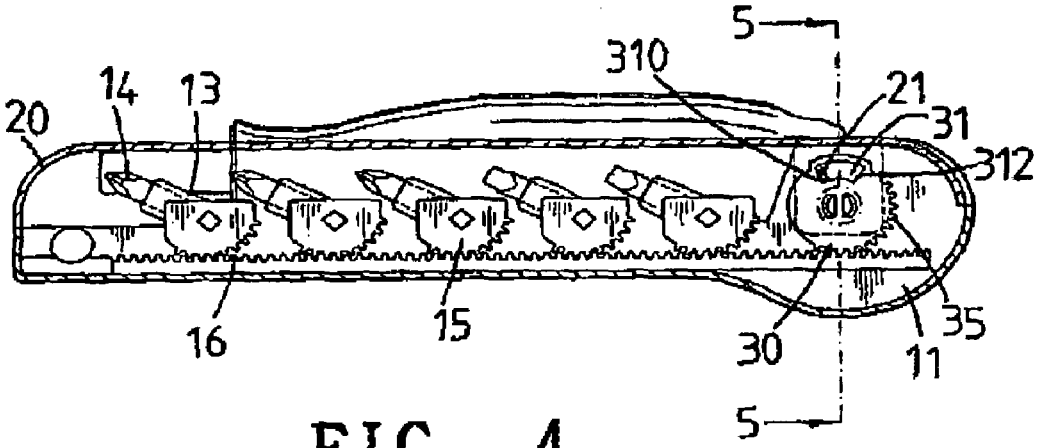
FIG. 4 is a side plan cross-sectional view of the tool box as shown in FIG. 1.
Figure 6:
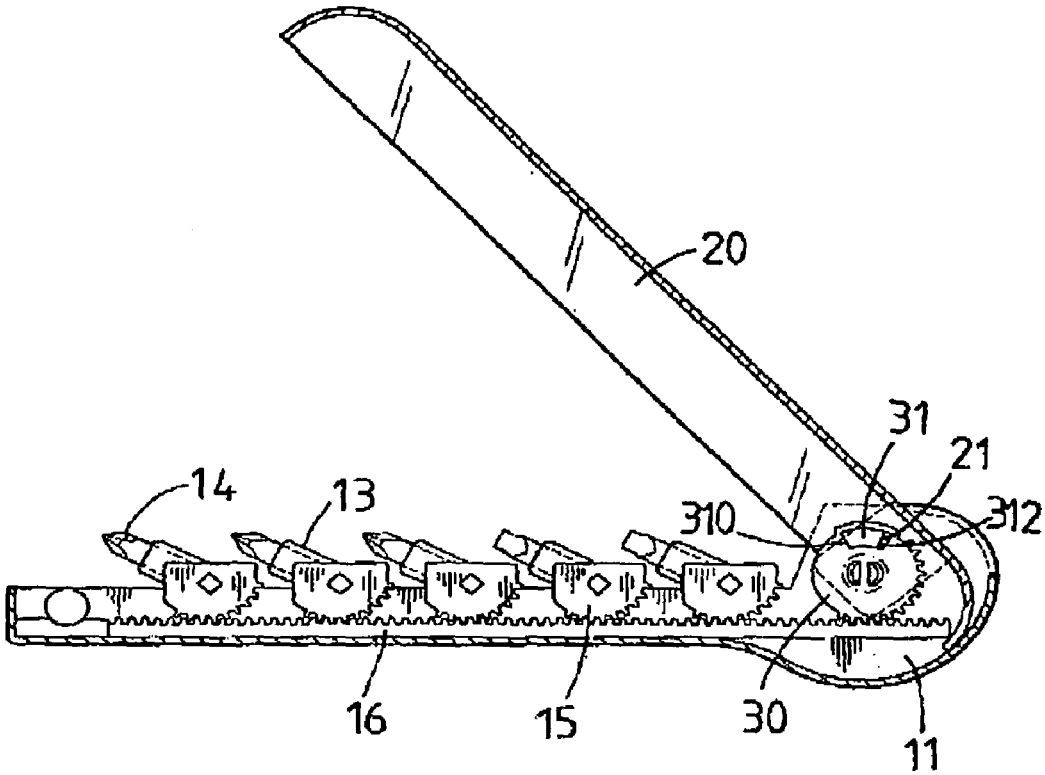
FIG. 6 is a schematic operational view of the tool box as shown in FIG. 4 in use.

The rotation gear 30 has a periphery formed with a sector-shaped guide slot 31, and the pivot portion 25 of the cover 20 is provided with a protruding locking block 21 slidably mounted in the guide slot 31 of the rotation gear 30. In addition, the guide slot 31 of the rotation gear 30 has a first end formed with a first limit 310 and a second end formed with a second limit 312, so that the locking block 21 of the cover 20 is limited to move between the first limit 310 and the second limit 312 of the guide slot 31 of the rotation gear 30 as shown in FIGS. 4 and 6. In addition, the rotation gear 30 has an outer diameter provided with a plurality of teeth 35 which extend through one half of the outer diameter of the rotation gear 30.

Figure 7:
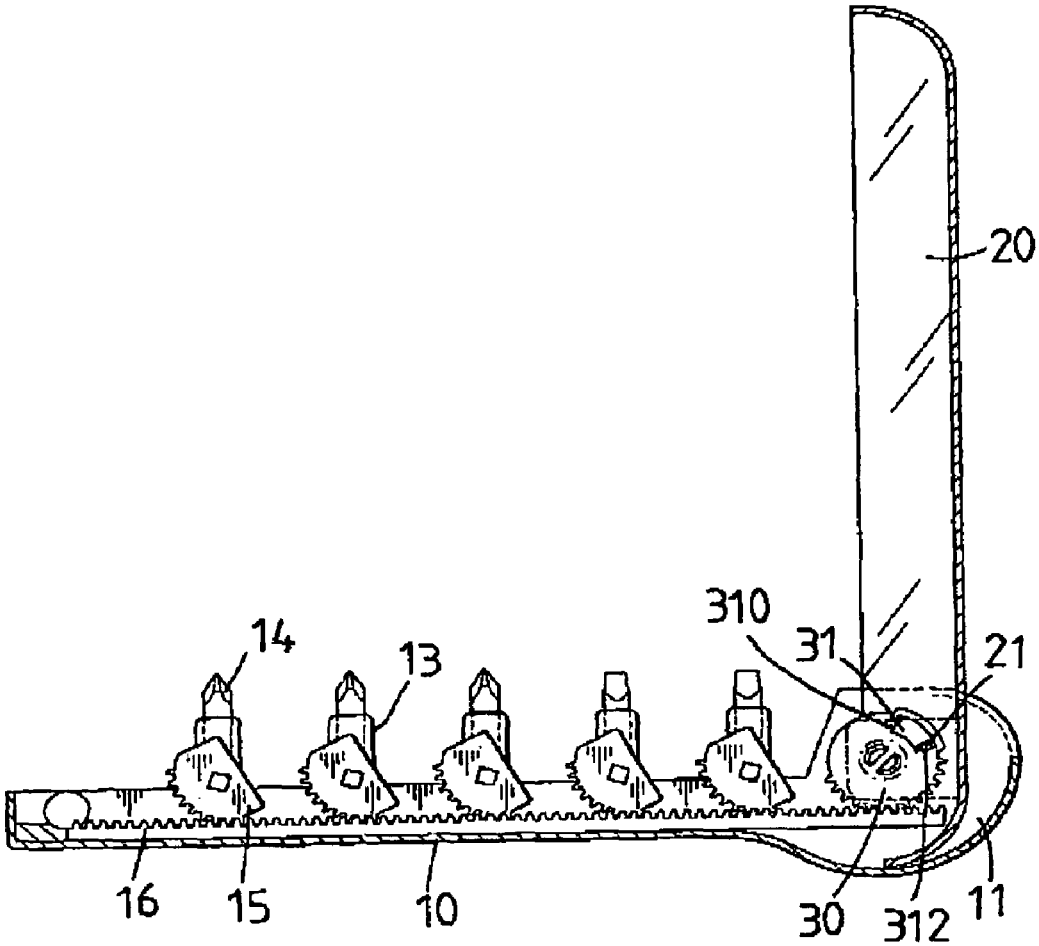
FIG. 7 is a schematic operational view of the tool box as shown in FIG. 6 in use.

In operation, referring to FIGS. 1-7, when the cover 20 is in parallel with the main body 10, the locking block 21 of the cover 20 is rested on the first limit 310 of the guide slot 31 of the rotation gear 30 as shown in FIG. 4. When the cover 20 is pivoted relative to the main body 10, the locking block 21 of the cover 20 is driven to move in the guide slot 31 of the rotation gear 30. Then, the cover 20 is pivoted relative to the main body 10 to the position as shown in FIG. 6 where the included angle between the cover 20 and the main body 10 is about 45 degrees, the locking block 21 of the cover 20 is rested on the second limit 312 of the guide slot 31 of the rotation gear 30 as shown in FIG. 6. When the cover 20 is further pivoted relative to the main body 10, the locking block 21 of the cover 20 is moved to push and move the second limit 342 of the guide slot 31 of the rotation gear 30, so that the rotation gear 30 is rotated by pivot of the cover 20. Thus, the driving rack 16 is moved by rotation of the rotation gear 30 to rotate the rotation block 15 of each of the receiving portions 13, so that each of the receiving portions 13 is pivoted upward relative to the main body 10. When the cover 20 is further pivoted relative to the main body 10 to the position as shown in FIG. 7 where the included angle between the cover 20 and the main body 10 is about 90 degrees, each of the receiving portions 13 is vertical to the main body 10, thereby facilitating the user removing the screwdriver tip 14 from each of the receiving portions 13.

Accordingly, the locking block 21 of the cover 20 is movable in the guide slot 31 of the rotation gear 30, thereby forming a time delay during pivotal movement between the cover 20 and the rotation gear 30, so that when the included angle between the cover 20 and the main body 10 is smaller than 45 degrees, the rotation gear 30 is not rotated by pivot of the cover 20. Thus, only one half of the rotation gear 30 is rotated by pivot of the cover 20, so that the teeth 35 only need to extend through one half of the outer diameter of the rotation gear 30, thereby saving costs of fabrication, and thereby simplifying the manufacturing procedures. In addition, the rotation gear 30 is not rotated by pivot of the cover 20 simultaneously, thereby preventing the rotation gear 30, the driving rack 16 and the rotation block 15 from being worn out due to successive rotation by pivot of the cover 20, so as to increase the lifetime the rotation gear 30, the driving rack 16 and the rotation block 15.

Figure 8:
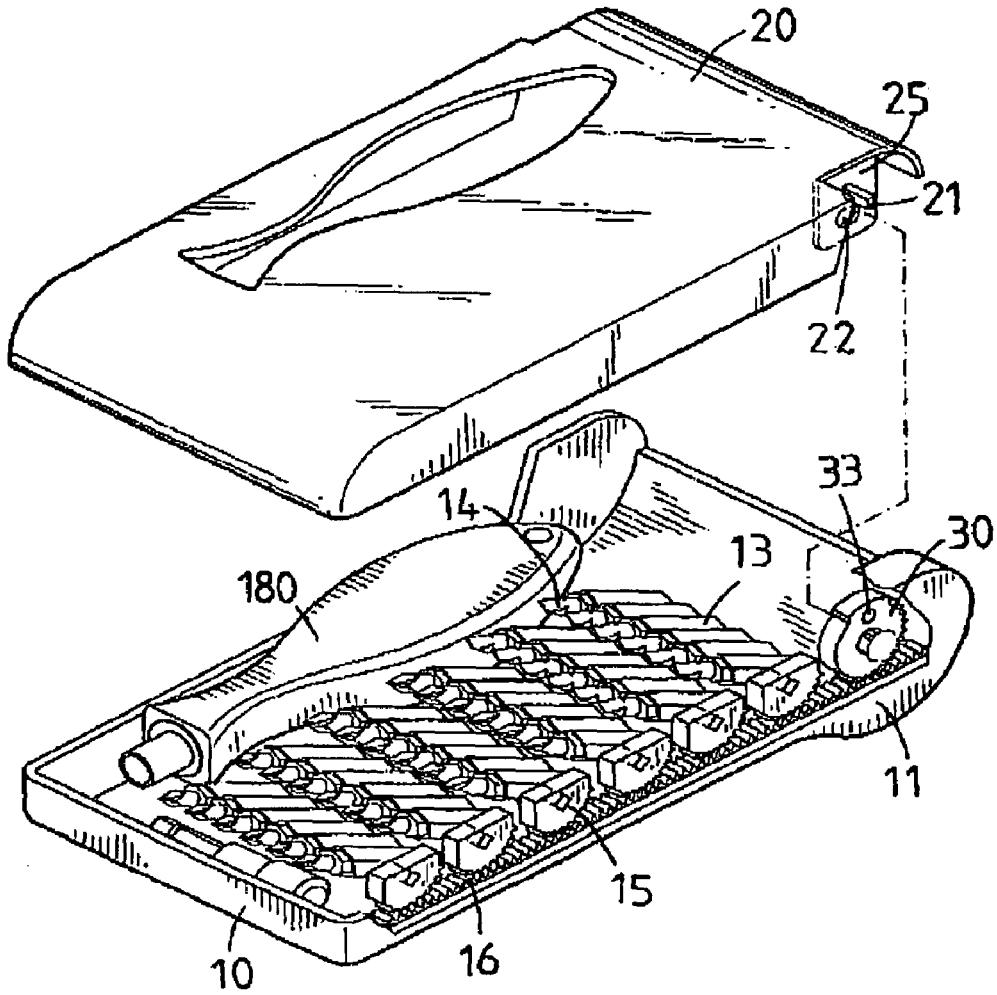
FIG. 8 is a partially exploded perspective view of a tool box in accordance with another embodiment of the present invention.
Figure 9:
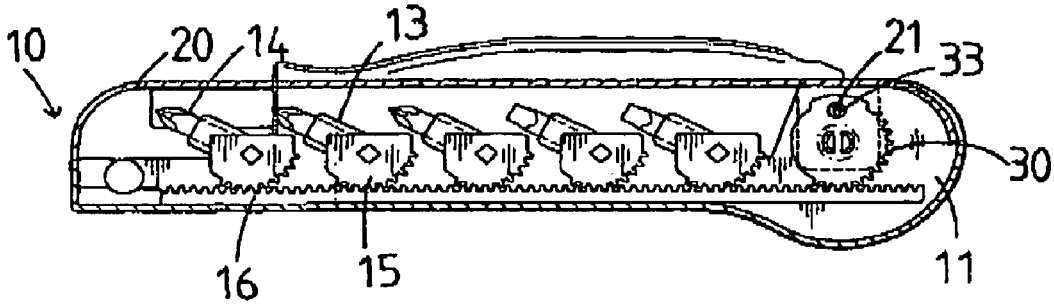
FIG. 9 is a side plan cross-sectional assembly view of the tool box as shown in FIG. 8.
Figure 10:
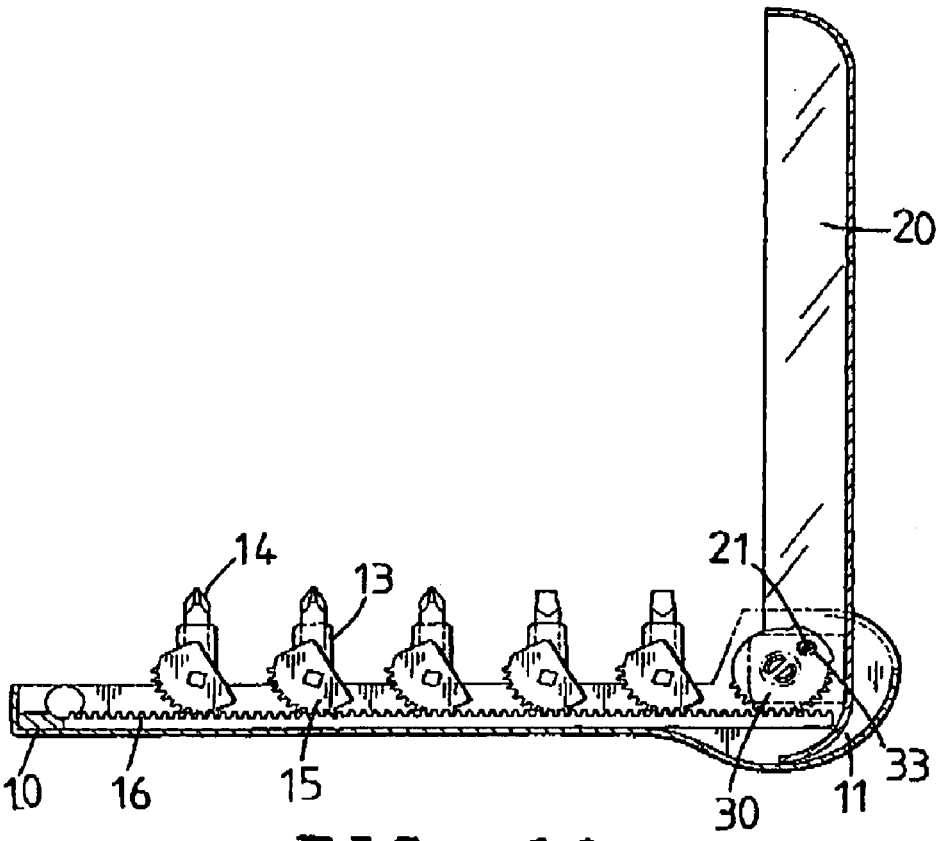
FIG. 10 is a schematic operational view of the tool box as shown in FIG. 9 in use.

Referring to FIGS. 8-10, a tool box in accordance with another embodiment of the present invention is shown, wherein the rotation gear 30 has a periphery formed with a circular through hole 33, and the pivot portion 25 of the cover 20 is provided with a protruding locking block 21 mounted in the through hole 33 of the rotation gear 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tool box, comprising: a main body; a cover pivotally mounted on the main body; an elongated driving rack movably mounted in the main body; a plurality of receiving portions each pivotally mounted in the main body and each having a side provided with a toothed rotation block meshing with and rotated by the driving rack; and a rotation gear secured on and rotated by the cover and meshing with the driving rack for moving the driving rack; and wherein the rotation gear has a periphery formed with a guide slot, and the cover is provided with a protruding locking block slidably mounted in the guide slot of the rotation gear.

2. The tool box in accordance with claim 1, wherein the guide slot of the rotation gear is sector-shaped.

3. The tool box in accordance with claim 1, wherein when the cover is pivoted relative to the main body, the locking block of the cover is driven to move in the guide slot of the rotation gear.

4. The tool box in accordance with claim 1, wherein the guide slot of the rotation gear has a first end formed with a first limit and a second end formed with a second limit, so that the locking block of the cover is limited to move between the first limit and the second limit of the guide slot of the rotation gear.

5. The tool box in accordance with claim 4, wherein when the cover is in parallel with the main body, the locking block of the cover is rested on the first limit of the guide slot of the rotation gear.

6. The tool box in accordance with claim 4, wherein when the cover is pivoted relative to the main body to a position where the included angle between the cover and the main body is about 45 degrees, the locking block of the cover is rested on the second limit of the guide slot of the rotation gear.

7. The tool box in accordance with claim 4, wherein when the cover is further pivoted relative to the main body to a position where the included angle between the cover and the main body is about 90 degrees, each of the receiving portions is pivoted to be vertical to the main body.

8. A tool box, comprising: a main body; a cover pivotally mounted on the main body; an elongated driving rack movably mounted in the main body; a plurality of receiving portions each pivotally mounted in the main body and each having a side provided with a toothed rotation block meshing with and rotated by the driving rack; and a rotation gear secured on and rotated by the cover and meshing with the driving rack for moving the driving rack; and wherein the rotation gear has a periphery formed with a circular through hole, and a pivot portion of the cover is provided with a protruding locking block mounted in the through hole of the rotation gear.

* * * * *